US005586464A

United States Patent [19]

Horde et al.

[11] Patent Number: 5,586,464

[45] Date of Patent: Dec. 24, 1996

[54] MODULAR DIE TRANSFER SYSTEM

[75] Inventors: Boice F. Horde, Westland; Denver Akers, Lincoln Park, both of Mich.

[73] Assignee: Livernois Die and Automation, Dearborn, Mich.

[21] Appl. No.: 546,537

[22] Filed: Oct. 20, 1995

[51] Int. Cl.[6] ..... B21D 43/05

[52] U.S. Cl. ..... 72/405.16; 72/405.13; 198/621.3

[58] Field of Search ..... 72/405.11–405.16, 72/405.09, 405.01; 198/621.3, 621.1

[56] References Cited

U.S. PATENT DOCUMENTS

| | | | |
|---|---|---|---|
| 3,988,937 | 11/1976 | Higuchi | 72/405.13 |
| 4,032,018 | 6/1977 | Wallis . | |
| 5,136,874 | 8/1992 | Fisch | 72/405.12 |
| 5,307,666 | 5/1994 | Bianchi . | |

FOREIGN PATENT DOCUMENTS

| | | | |
|---|---|---|---|
| 185164 | 7/1993 | Japan | 72/405.01 |

OTHER PUBLICATIONS

Wallis, "Transfer Die Technology", Livernois Automation Company (1991).

"Rotary Cam Series Transfer Systems", Livernois Automation Company, Brochure LAC–2003 (Feb. 1990).

*Primary Examiner*—Daniel C. Crane

*Attorney, Agent, or Firm*—Barnes, Kisselle, Raisch, Choate, Whittemore & Hulbert, P.C.

[57] ABSTRACT

A die transfer system for transferring workpieces through successive dies stations in a stamping press includes an elongated finger bar having spaced fingers for engaging workpieces at successive die stations. A drive module for reciprocating the finger bar laterally into and out of engagement with the workpieces at the die stations, and for lifting the workpieces above the level of the die stations for longitudinal transfer between die stations. The drive module has a crank arm coupled to the drive shaft for rotating the crank arm about an axis parallel to the finger bar. A cam plate is coupled to the finger bar and mounted for movement lateral to the crank arm axis and the finger bar. The cam plate has a cam slot with first and second orthogonal portions lateral to the crank arm axis, and a third arcuate portion interconnecting the first and second portions at the radius of the crank arm. A cam follower is mounted on the crank arm and disposed in the slot, such that rotation of the drive shaft rotates the crank arm and propels the cam follower along the first, third and second portions of the slot and sequence, with the third slot portion providing a dwell at the cam plate and finger bar during motion of the cam follower therethrough.

13 Claims, 3 Drawing Sheets

MODULAR DIE TRANSFER SYSTEM

The present invention is directed to die transfer systems, and more particularly to a modular arrangement for indexing workpieces through successive die stations in a stamping press.

BACKGROUND AND OBJECTS OF THE INVENTION

In die transfer systems of the subject character, a finger bar extends along one or both lateral sides of the die stations of a stamping press, and fingers extend inwardly from the finger bar or bars for engaging workpieces at the successive die stations. The finger bar or bars are driven longitudinally and laterally in synchronism with operation of the press for transferring workpieces through successive die stations and then out of the die. U.S. Pat. Nos. 4,032,018 and 5,307,666 each disclose die transfer systems of this general character, in which the finger bars are mechanically coupled by cam-and-follower arrangements to the ram of the stamping press for controlling operation of the finger bars.

U.S. application Ser. No. 08/280,089, assigned to the assignee hereof, discloses a die transfer system in which the drive mechanism for moving the fingers laterally into and out of engagement with the workpieces comprises at least two finger bar drive modules coupled to the finger bar and spaced from each other lengthwise of the finger bar. A drive shaft extends between and interconnects the two drive modules. Each of the drive modules includes a crank arm coupled to the drive shaft for rotating the crank arm about an axis parallel to the finger bar. A cam plate is coupled to the finger bar and mounted for movement lateral to the crank arm axis and the finger bar. The cam plate has orthogonal interconnected slots each extending in a direction lateral to the crank arm axis. A cam follower is mounted on the crank arm and disposed in the slots, such that rotation of the drive shaft rotates the crank arm and propels the cam follower along the cam plate slots in sequence so as to move the cam plate and the finger bar sequentially horizontally and vertically with respect to the die stations. The drive shaft is rotated in synchronism with operation of the stamping press, preferably by an electric servo motor and motor controller coupled to a sensor for monitoring position of the stamping press.

Although the die transfer systems disclosed in the noted patents and pending application have enjoyed commercial acceptance and success, further improvements remain desireable. For example, in the transfer system disclosed in the noted co-pending application, the point of maximum velocity and maximum torque on the crank arm, drive shaft and motor are at the point of transition between horizontal and vertical motions at the finger bar. Such an arrangement produces undesirably high loads on the drive motor, shaft and associated components, such as the shaft bearings and transfer gears. Motion at the finger bar is essentially continuous as the crank arm rotates and the cam follower moves through the cam plate slots. Also, in the system disclosed in the pending application, there is a cam lock arrangement provided for preventing reverse horizontal movement of the finger bar and cam plate during vertical motion, which requires addition components and assembly time, thus undesirably increasing the cost of manufacture. It is a general object of the present invention to provide a modular die transfer system of the subject character that addresses one or more of these undesirable features of the prior art.

SUMMARY OF THE INVENTION

A die transfer system for transferring workpieces between successive die stations in a stamping press includes at least one elongated finger bar having spaced fingers for engaging workpieces at successive die stations, a first drive mechanism for reciprocating the finger bar longitudinally for transferring workpieces between successive die stations, and a second drive mechanism for reciprocating the finger bar laterally horizontally and vertically into and out of engagement with the workpieces at the die stations. The second drive mechanism comprises at least one finger bar drive module coupled to the finger bar and a drive shaft connected to the drive module.

The drive module includes a crank arm coupled to the drive shaft for rotating the crank arm about an axis parallel to the finger bar. A cam plate is coupled to the finger bar and mounted for movement in both horizontal and vertical directions lateral to the crank arm axis and the finger bar. The cam plate has a cam slot with first and second slot portions lateral to the crank arm axis and orthogonal to each other. An arcuate third slot portion interconnects the first and second portions to form a continuous slot arrangement. The arcuate third slot portion has a radius equal to the radius of the cam follower with respect to the crank arm axis. Rotation of the drive shaft and the crank arm propels the cam follower along the first, third and second slot portions in sequence, and thereby drives the cam plate and the finger bar in first and second directions at right angles to the crank arm axis and to each other during motion of the cam follower along the first and second slot portions respectively. The third portion of the slot provides a dwell at the cam plate and the finger bar during motion of the cam follower through the third slot portion.

The crank arm and cam plate are constructed in the preferred embodiment of the invention for up to 180° of rotation at the crank arm during motion of the cam follower in the first slot portion, and up to 180° of rotation at the crank arm during motion of the cam follower in the second slot portion. In this way, up to 450° of rotation at the crank arm is provided during motion of the cam follower through the first, third and second slot portions in sequence. The preferred embodiment of the invention thus provides two significant advantages over the system disclosed in the above-noted co-pending application. First, there is a dwell at the finger bar between horizontal and vertical motions at the finger bar for a time corresponding to 90° of rotation at the crank arm. During this dwell, operations may be performed on the workpieces while grasped by the fingers over the die stations, if desired. Second, torque and load on the finger bar drive mechanism is greatly reduced as compared with the prior art, thus reducing component wear and increasing component life.

In accordance with a second important feature of the present invention, the cam locking mechanism for preventing horizontal motion during vertical motion at the cam plate and finger bar comprises a locking cam coupled for co-rotation with the crank arm about the crank arm axis. The locking cam has a locking slot concentric with the crank arm axis and opening radially from the crank arm axis. A locking cam follower is operatively coupled to the cam plate for movement conjointly with the cam plate into and out of the locking slot during motion of the cam plate in the first or horizontal direction, and is captured within the locking slot of the locking cam during motion of the cam plate in the second or vertical direction. The locking cam preferably takes the form of a hub having the locking slot disposed in an axially oriented face and extending circumferentially at constant radius around the axis of the hub. The locking cam follower preferably comprises a follower plate coupled to the cam plate and a roller mounted on the follower plate. The locking slot in the locking cam hub opens radially outwardly over an angular portion of the hub to receive the locking cam follower roller as the cam plate and finger bar are moved horizontally into engagement with workpieces at the die stations. Further rotation of the locking cam hub captures the roller within the locking slot and thereby prevents horizontal movement of the locking cam follower and cam plate during vertical motion of the cam plate and finger bar.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figure 1:
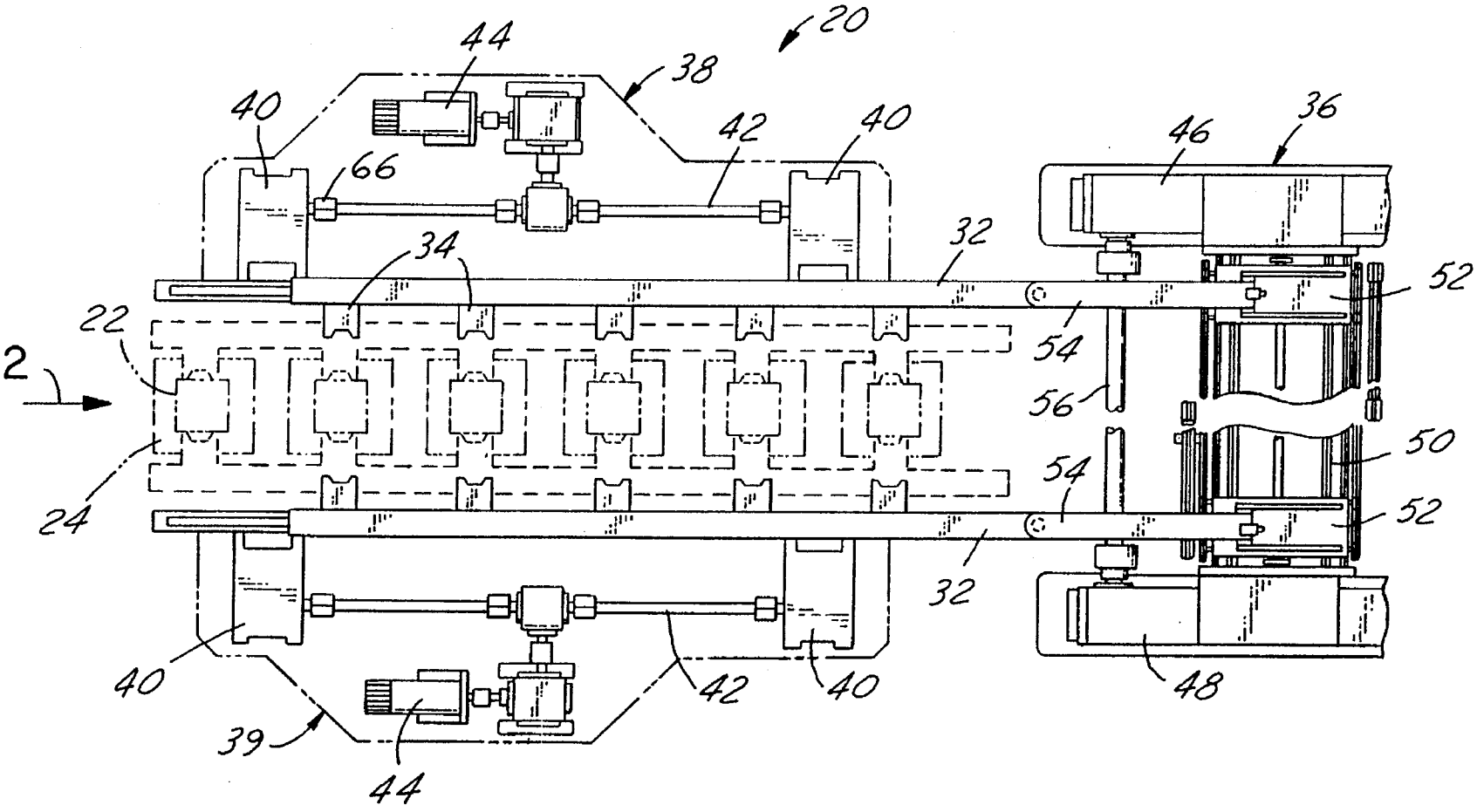
FIG. 1 is a plan view of a die transfer system in accordance with one presently preferred embodiment of the invention.
Figure 2:
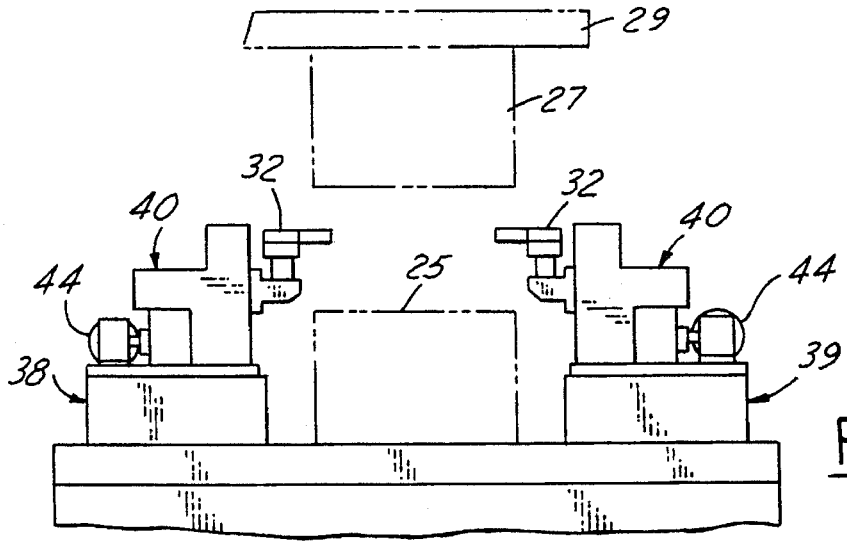
FIG. 2 is an end elevational view of the die transfer system illustrated in FIG. 1 viewed from the direction 2 in FIG. 1.

FIGS. 1 and 2 illustrate a die transfer system 20 in accordance a presently preferred embodiment of the invention for transferring workpieces 22 between successive die stations 24. Die stations 24 are positioned on the lower die 25 (FIG. 2) of a stamping press having an upper die 27 coupled to a press ram 29. Returning to FIG. 1, transfer system 20 includes a pair of elongated parallel finger bars 32 each having a plurality of longitudinally spaced fingers 34 for engaging workpieces 22 at successive die stations 24. (It will be appreciated, of course, that directional adjectives such as "longitudinal" and "lateral" are taken with reference to the direction of motion of workpieces 22 between and through successive die stations 24.) A longitudinal or transfer drive module 36 is positioned at one end of transfer system 20, and is coupled to finger bars 32 for reciprocating the finger bars back and forth in the direction of their length, thereby sequentially transferring workpieces through the successive die stations. A pair of laterally opposed drive modules 38, 39 are coupled to finger bars 32 for reciprocating the finger bars laterally into and out of engagement with workpieces at the die stations, and for lifting the workpieces above the level of the die stations for longitudinal motion between the die stations.

Lateral drive modules 38, 39 are mirror images of each other. Each lateral drive module 38, 39 has at least two finger bar modules 40 coupled to the associated finger bar 32 and spaced from each other lengthwise of the finger bar. A drive shaft 42 extends between and interconnects drive modules 40. Drive shaft 42 is rotated in synchronism with operation of the stamping press by an electric servo motor 44 and associated controller coupled to a sensor for monitoring position of the stamping press. Longitudinal drive module 36 includes a pair of belt drive mechanisms 46, 48 interconnected by a bridge 50. A pair of carriages 52 are mounted on bridge 50, and are connected by arms 54 to respective finger bars 32. A motor (not shown) and a drive shaft 56 interconnect belt drives 46, 48 for driving the belt drives reciprocally in the longitudinal direction. To the extent thus far described, transfer system 20 is similar to those disclosed in above-noted U.S. Application Ser. No. 08/280,089, and in application Ser. No. 08/546,538, the disclosures of which are incorporated herein by reference.

Figure 3:
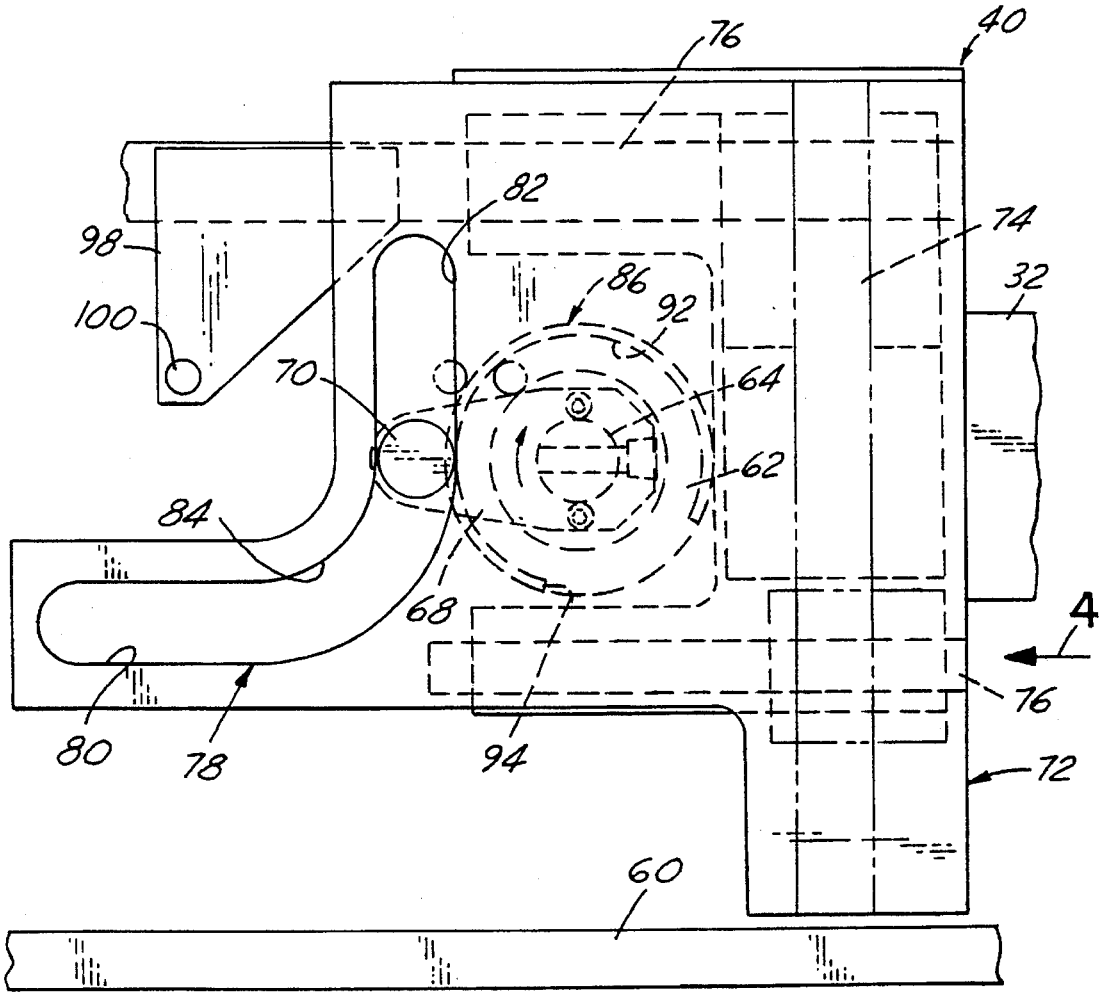
FIG. 3 is a side elevational view of a transfer module in the die transfer system illustrated in FIGS. 1 and 2.
Figure 4:
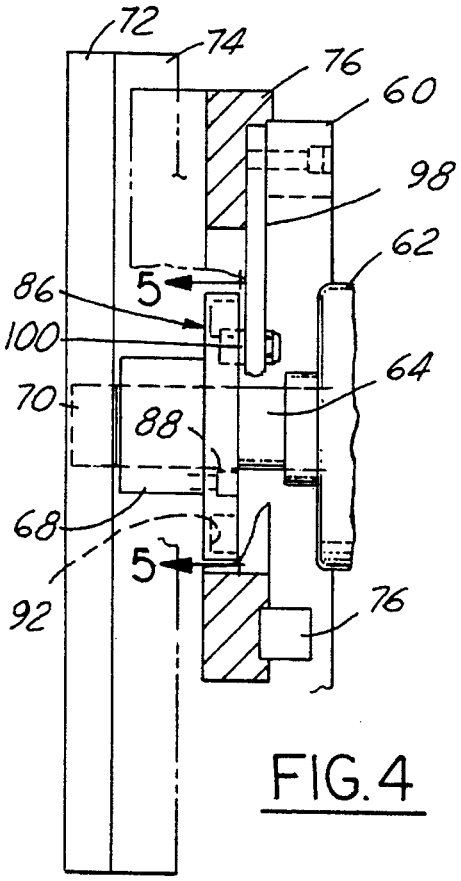
FIG. 4 is a partially fragmented end elevational view taken from the direction 4 in FIG. 3.
Figure 5:
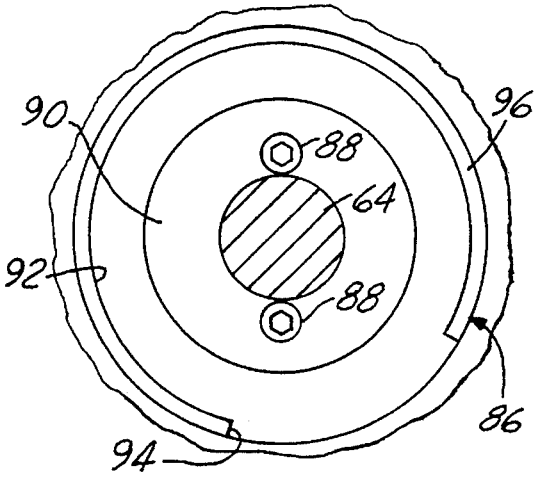
FIG. 5 is a fragmentary sectional view taken substantially along the line 5—5 in FIG. 4.

FIGS. 3–5 illustrate drive module 40 in greater detail. A support frame 60 carries a bearing 62 that rotatably supports a stub shaft 64 that is removably connected to drive shaft 42 (FIG. 1) by a coupler 66. A crank arm 68 is affixed to and extends radially from stub shaft 64 for co-rotation therewith. (A gear transmission may be disposed between the stub shaft coupled to the drive shaft and the stub shaft that carries the crank arm, the two stub shafts being parallel to but offset from each other.) A cam roller 70 is rotatably mounted on the end of crank arm 68. A cam plate 72 is mounted by a vertically oriented linear bearing 74 between a pair of horizontally oriented linear bearings 76, which in turn are mounted to support 60. Cam plate 72 is thus free to move vertically along the axis of linear bearing 74, and horizontally along the parallel axes of linear bearings 76. Cam plate 72 has a slot 78 formed therein, into which crank arm roller 70 is received. Slot 78 has first and second end portions 80, 82 that are lateral to the axis of rotation of crank arm 68 and orthogonal to each other, respectively extending horizontally and vertically as illustrated in FIG. 3. Slot portions 80, 82 are interconnected by an arcuate third slot portion 84 so as to form a continuous slot 78. Slot portion 84 has a constant radius of curvature equal to the radius of movement of roller 78 about the axis of crank arm 68.

A cam lock 86 is affixed by screws 88 to the inboard face of crank arm 68 surrounding stub shaft 64. As best seen in FIGS. 4 and 5, cam lock 86 generally comprises a circular hub plate 90 having a slot 92 that extends circumferentially entirely around one axially oriented face of hub plate 90 concentrically with the hub plate and the axis of rotation of shaft 64. A slot 94 is formed in the wall 96 that surrounds slot 92 and opens radially outwardly from slot 92. A follower plate 98 is affixed to and depends from linear bearing 76 adjacent to the axial face of cam lock 86 in which slot 92 is formed. A roller 100 is mounted on follower plate 98 at a position to be received through slot 94 into slot 92 of cam lock 86, as will be described.

In the position of drive module 40 illustrated in FIG. 3, crank arm 68 extends horizontally away from finger bar 32, and roller 70 is received in slot 78 at the lower end of slot portion 82. In this position of crank arm 68 and cam plate 72, finger bar 32 is fully retracted horizontally outwardly from lower die 25 (FIG. 2) and finger bar 32 is in the fully lowered position. To initiate a workpiece transfer operation, servo motor 44 (FIG. 1) is activated to rotate drive shaft 42 and crank arm 68 in the clockwise direction as viewed in FIG. 3 (and FIGS. 6–8). As crank arm 68 rotates 180° from the position illustrated in FIG. 3 to the position illustrated in FIG. 6, follower roller 72 is propelled upwardly in slot portion 82 to adjacent the upper end of the slot when crank arm 68 is vertical, and then to its original position in slot portion 82 as crank arm 68 is rotated further to the horizontal position extending toward finger bar 32, as shown in FIG. 6.

Cam plate 72 is thus propelled horizontally toward the die stations, carrying the finger bar and fingers into engagement with workpieces at the die stations. At the same time, roller 100 on follower plate 98 is carried by bearing 76 conjointly with cam plate 72 from the position illustrated in FIG. 3 to the position illustrated in FIG. 6. In the latter position, roller 100 has entered locking slot 92 through radial opening 94.

Figure 6:
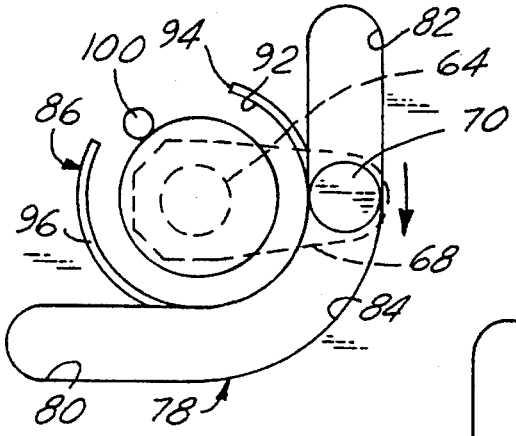
FIGS. 6–8 are schematic illustrations of the crank arm, follower plate and cam locking mechanism of the present invention in sequential stages of operation.
Figure 7:
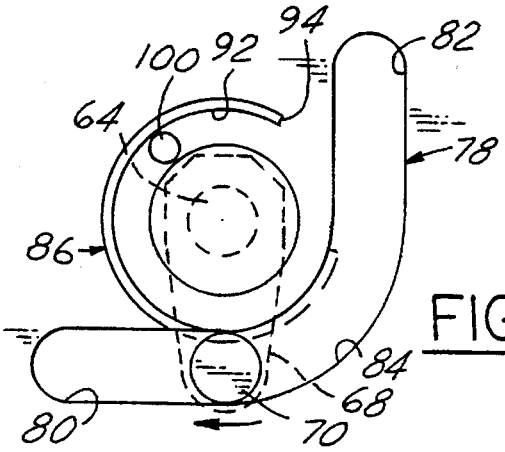

Continued rotation of drive shaft 42 (FIG. 1), stub shaft 64 and crank arm 68 in the clockwise direction from the horizontal position illustrated in FIG. 6 to the vertically downward orientation illustrated in FIG. 7 causes roller 70 to traverse slot portion 84. However, because slot portion 84 has the same radius of curvature as the radius of motion of roller 70 on crank arm 68, as noted above, there is no corresponding motion of cam plate 72. There is thus a dwell at finger bar 32, after the fingers have engaged the workpieces at the die stations and the workpieces are still on the die stations, for a time corresponding to 90° of rotation of crank arm 68. However, rotation of crank arm 68 and locking cam 86 carried thereby rotates opening 94 away from roller 100, so that roller 100 is captured within slot 92 of locking cam 86.

Figure 8:
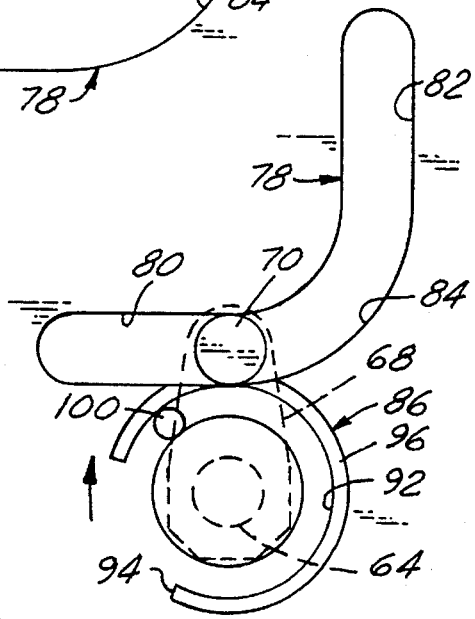

From the position illustrated in FIG. 7 to the position illustrated in FIG. 8, crank arm 68 is rotated an additional 180° clockwise. (It will be appreciated, of course, that rotation from the position of FIG. 3 through the positions of FIGS. 6–7 is normally one continuous motion, as is the reverse motion for lowering and retracting the finger bar.) During this rotation, roller 70 is propelled through slot portion 80 to the end of the slot, and then back to the original position adjacent to the open end of slot portion 80. During such motion, cam plate 72 is lifted from its fully lowered position in FIGS. 3–7 to a fully raised position, lifting the workpieces off of the die stations. At this point, rotation of drive shaft 42 and crank arms 68 is arrested, and pitch drive mechanism 36 is activated to transfer the workpieces between successive die stations. Following such transfer, drive shaft 42 and crank arms 68 are now activated in the opposite direction from that previously described, from the position illustrated in FIG. 8 counterclockwise through the position illustrated in FIG. 7 and the position illustrated in FIG. 6 to the position illustrated in FIG. 3. Such crank arm rotation first lowers cam plate 72 and finger bar 32 (FIG. 8 to FIG. 7), then implements a dwell at the finger bar (FIG. 7 to FIG. 6), and then retracts the finger bar away from the workpieces (FIG. 6 to FIG. 3).

During the time in which cam plate 72 and finger bar 32 are raised and lowered, roller 100 is trapped within slot 92 of locking cam 86, as illustrated in FIGS. 7 and 8. This entrapment of roller 100, and consequent holding of follower plate 98 and bearing 76, holds cam plate 72 in horizontal position, and prevents the cam plate and finger bar from moving horizontally outwardly as cam plate 72 is raised and lowered, and as finger bar 32 is indexed longitudinally by pitch drive 36 (FIG. 1). Furthermore, the dwell in cam plate and finger bar motion immediately after the finger bars are moved laterally inwardly to grasp the workpieces, and immediately before the finger bars are moved laterally outwardly to release the workpieces, provides an opportunity for operations on the workpieces at the die stations while they are held in position by the finger bars, if desired. Furthermore, it will be recognized that the loads on crank arm 68, stub shaft 64, drive shaft 42 and motor 44 are greatly reduced. Each movement of the finger bar in the embodiment illustrated in the drawings requires up to 180° of rotation of the crank arm, as distinguished from 90° of rotation typical of the prior art. Maximum cam plate velocity is achieved midway in each motion, rather than at the end of each motion as is typical in the prior art. It will be recognized, of course, that the total motion of the cam plate and finger bar either horizontally or vertically can be reduced by appropriately controlling motor 44. Thus, there is a total of 450° of available rotation of crank arm 68 for effecting cam plate and finger bar movement, up to 180° during horizontal motion, up to 180° during vertical motion, and a dwell of 90°.

We claim:

1. In a die transfer system for transferring workpieces between successive die stations in a stamping press, and including elongated bar means having spaced means for engaging workpieces at successive die stations, first means for reciprocating said bar means longitudinaily for transferring workpieces between successive die stations, and second means for reciprocating said bar means horizontally into and out of engagement with workpieces at the die stations and vertically upwardly and downwardly with respect to the die stations, said second means comprising:

at least one drive module coupled to said bar means, drive shaft means coupled to said drive module, and means coupled to said drive shaft means for operating said drive shaft means and said drive module in synchronism with operation of the stamping press, said drive module comprising:

crank arm means, means operatively coupling said crank arm means to said drive shaft means for rotating said crank arm means about an axis parallel to said bar means, cam plate means coupled to said bar means and mounted for movement laterally of said axis both horizontally and vertically with respect to said axis, cam slot means extending along said cam plate means, and cam follower means disposed in said slot means and coupled to said crank arm means, the improvement wherein said slot means includes first and second slot portions lateral to said axis and orthogonal to each other, and an arcuate third portion interconnecting said first and second portions, said arcuate third portion having a constant radius equal to radius of said cam follower means with respect to said crank arm axis, rotation of said drive shaft means and said crank arm means propelling said cam follower means along said first, third and second slot portions in sequence, and thereby driving said cam plate means and said bar means in first and second directions at right angles to said axis and to each other during motion of said cam follower means along said first and second slot portions, and with a dwell at said cam plate means and said bar means during motion of said cam follower means through said third slot portion.

2. The transfer system set forth in claim 1 wherein said crank arm means and said cam plate means are constructed for up to 180° of rotation at said crank arm means during motion of said cam follower means in said first slot portion and up to 180° of rotation at said crank arm means during motion of said cam follower means in said second slot portion, thereby providing up to 450° of rotation at said crank arm means during motion of said cam follower through said first, third and second slot portions in sequence.

3. The system set forth in claim 1 wherein each said drive module further comprises locking cam means operatively coupled to said drive shaft for corotation with said crank arm means, and locking cam follower means operatively coupled to said cam plate means for locking engagement with said locking cam means during motion of said cam follower means along said second slot portion to prevent said cam plate means and said bar means from reverse motion in said first direction during motion in said second direction.

4. The transfer system set forth in claim 3 wherein said locking cam means comprises a locking cam coupled for corotation with said crank arm means about said axis and having a locking slot concentric with and opening radially outwardly from said axis, and wherein said locking cam follower means comprises means coupled to said cam plate means for movement into and out of said locking slot during motion of said cam plate means in said first direction and being captured within said locking slot during motion of said cam plate means in said second direction.

5. The system set forth in claim 4 wherein said drive module further includes support means and orthogonal bearing means mounting said cam plate means to said support means, said locking cam follower means being mounted on said bearing means for motion in said one direction conjointly with said cam plate means.

6. The transfer system set forth in claim 5 wherein said locking cam means comprises a hub having an axial face, said locking slot being disposed in said face and extending circumferentially around said hub.

7. The transfer system set forth in claim 6 wherein said locking cam follower means comprises a follower plate coupled to said cam plate means and a roller mounted on said follower plate for capture in said locking slot.

8. In a die transfer system for transferring workpieces between successive die stations in a stamping press, and including elongated bar means having spaced means for engaging workpieces at successive die stations, first means for reciprocating said bar means longitudinally for transferring workpieces between successive die stations, and second means for reciprocating said bar means laterally into and out of engagement with the workpieces at the die stations, said second means comprising:

at least one drive module coupled to said bar means, drive shaft means coupled to said drive module, and means coupled to said drive shaft means for operating said drive shaft means and said drive module in synchronism with operation of the stamping press, the improvement wherein said drive module comprises:

crank arm means, means operatively coupling said crank arm means to said drive shaft means for rotating said crank arm means about an axis parallel to said bar means, cam plate means coupled to said bar means and mounted for movement lateral to said axis and said finger bar, said cam plate means having cam slot means extending in orthogonal directions lateral to said axis, cam follower means disposed in said slot means and coupled to said crank arm means such that rotation of said drive shaft means rotates said crank arm means and propels said cam follower means along said slot means to drive said cam plate means and said bar means sequentially in first and second directions orthogonal to said axis, locking cam means coupled for corotation with said crank arm means about said axis and having a locking slot concentric with and opening radially from said axis, and locking cam follower means operatively coupled to said cam plate means for movement conjointly with said cam plate means into and out of said locking slot during motion of said cam plate means in said first direction and being captured within said locking slot during motion of said cam plate means in said second direction to prevent said cam plate means and said bar means from reverse motion in said first direction during motion in said second direction.

9. The transfer system set forth in claim 8 wherein said drive module further includes support means and orthogonal bearing means mounting said cam plate means to said support means, said locking cam follower means being mounted on said bearing means for motion in said one direction conjointly with said cam plate means.

10. The transfer system set forth in claim 9 wherein said locking cam means comprises a hub having an axial face, said locking slot being disposed in said face and extending circumferentially around said hub.

11. The transfer system set forth in claim 10 wherein said locking cam follower means comprises a follower plate coupled to said cam plate means and a roller mounted on said follower plate for capture in said locking slot.

12. The transfer system set forth in claim 8 wherein said cam slot means includes first and second slot portions lateral to said axis and orthogonal to each other, and an arcuate third portion interconnecting said first and second portions, said arcuate third portion having a constant radius equal to radius of said cam follower means with respect to said crank arm axis, rotation of said drive shaft means and said crank arm means propelling said cam follower means along said first, third and second slot portions in sequence, and thereby driving said cam plate means and said bar means in said first and second directions at right angles to said axis and to each other during motion of said cam follower means along said first and second slot portions, and with a dwell at said cam plate means and said bar means during motion of said cam follower means through said third slot portion.

13. The transfer system set forth in claim 12 wherein said crank arm means and said cam plate means are constructed for up to 180° of rotation at said crank arm means during motion of said cam follower means in said first slot portion and up to 180° of rotation at said crank arm means during motion of said cam follower means in said second slot portion, thereby providing up to 450° of rotation at said crank arm means during motion of said cam follower through said first, third and second slot portions in sequence.

* * * * *